US011078695B2

(12) United States Patent
Julien et al.

(10) Patent No.: US 11,078,695 B2
(45) Date of Patent: Aug. 3, 2021

(54) LOCKING MECHANISM COMPONENT FOR A MOTOR VEHICLE LOCK

(71) Applicant: Kiekert AG, Heiligenhaus (DE)

(72) Inventors: Keith Julien, Canton, MI (US); Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 872 days.

(21) Appl. No.: 15/556,073

(22) PCT Filed: Mar. 2, 2016

(86) PCT No.: PCT/IB2016/000213

§ 371 (c)(1),
(2) Date: Sep. 6, 2017

(87) PCT Pub. No.: WO2016/142761

PCT Pub. Date: Sep. 15, 2016

(65) Prior Publication Data

US 2018/0058115 A1 Mar. 1, 2018

Related U.S. Application Data

(60) Provisional application No. 62/129,062, filed on Mar. 6, 2015.

(51) Int. Cl.
*E05B 85/26* (2014.01)
*E05B 17/00* (2006.01)

(52) U.S. Cl.
CPC ..... *E05B 85/26* (2013.01); *E05B 17/0004* (2013.01)

(58) Field of Classification Search
CPC ..... Y10T 156/10; Y10T 29/49886; Y10T 428/19; Y10T 428/24967; Y10T 29/49474;

(Continued)

(56) References Cited

U.S. PATENT DOCUMENTS 3,610,668 A 10/1971 Tixier
4,534,191 A * 8/1985 Rogers ..... E05B 35/12 70/116

(Continued)

FOREIGN PATENT DOCUMENTS

DE 23 20 351 A1 10/1974
DE 102015121951 A1 * 6/2017 ..... B21D 53/88

(Continued)

OTHER PUBLICATIONS

International Search Report and Written Opinion for corresponding Patent Application No. PCT/IB2016/000213 dated May 27, 2016.

*Primary Examiner* — Mark A Williams
(74) *Attorney, Agent, or Firm* — Renner, Otto, Boisselle & Sklar, LLP

(57) ABSTRACT

The invention relates to a locking mechanism component, in particular a catch, for a motor vehicle lock for retaining and securing a closing member in a closed position of a door or hatch of a motor vehicle, comprising at least one first punched metal sheet and one second punched metal sheet, wherein the punched metal sheets are connected to each other in a non-detachable manner and the first punched metal sheet, compared to the second punched metal sheet, has a different punched metal sheet material and/or a greater punched metal sheet thickness, wherein the first punched metal sheet and the second punched metal sheet have at least partially or predominantly an identical outer contour and/or are disposed stacked one above the other in such a way that sections with an identical outer contour are disposed flush with each other on the outside. The invention further relates to a production method. A locking mechanism component with a great strength and longevity can be provided with a smaller production expenditure.

17 Claims, 1 Drawing Sheet

(58) Field of Classification Search
CPC ..... Y10T 428/12389; Y10T 428/12493; Y10T 428/31678; Y10T 156/1002; Y10T 156/1044; Y10T 156/1052; Y10T 292/1084; Y10T 29/49885; Y10T 29/49968; Y10T 403/478; Y10T 428/12347; B29C 66/723; B29C 66/72321; B21D 22/02; B21D 28/02; E05B 77/40; E05B 85/26; E05B 17/0004
See application file for complete search history.

(56) References Cited

U.S. PATENT DOCUMENTS 4,856,829 A * 8/1989 Nakamura ..... E05B 77/36 292/216
4,896,908 A * 1/1990 Kleefeldt ..... E05B 81/66 292/216
5,547,735 A * 8/1996 Roebroeks ..... B29C 70/088 428/110
5,951,800 A * 9/1999 Pettit ..... B29C 70/086 156/157
5,972,476 A * 10/1999 Field ..... B60R 25/021 156/196
7,955,713 B2 * 6/2011 Roebroeks ..... B64C 3/26 428/608
8,993,084 B2 * 3/2015 Griess ..... B29C 66/1282 428/60
9,617,760 B2 * 4/2017 Dragon ..... E05B 77/36
9,919,495 B2 * 3/2018 Wilson ..... G01B 21/08
10,378,243 B2 * 8/2019 Ke ..... E05B 63/14
2001/0015558 A1 * 8/2001 Fisher ..... E05B 85/26 292/216

FOREIGN PATENT DOCUMENTS

EP 1126108 A1 * 8/2001 ..... E05B 77/40
EP 1 130 201 A2 9/2001
EP 1 126 108 B1 7/2005

* cited by examiner

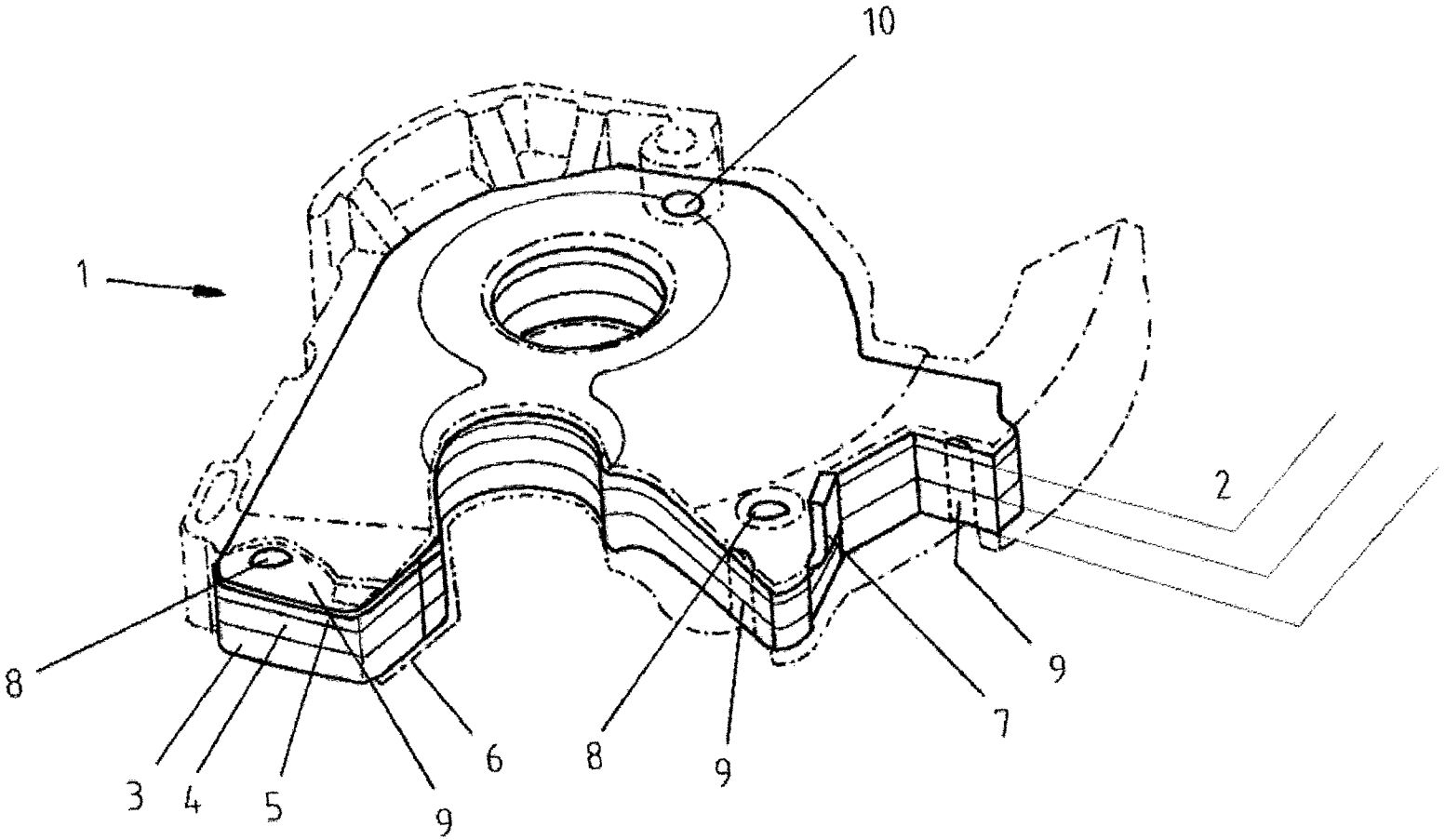
1
2
3
4
5
6
7
8
8
9
9
9
10

LOCKING MECHANISM COMPONENT FOR A MOTOR VEHICLE LOCK

This application is a national phase of International Application No. PCT/IB2016/000213 filed Mar. 2, 2016 and published in the English language, which claims the benefit of U.S. Provisional Patent Application No. 62/129,062 filed Mar. 6, 2015, which are hereby incorporated herein by reference.

The invention relates to a locking mechanism component, in particular a catch, for a motor vehicle lock according to the preamble of the main claim. The invention further relates to a method for producing a locking mechanism component.

A motor vehicle lock serves for temporarily locking a door or a hatch in a motor vehicle.

A lock for a motor vehicle comprises a locking mechanism with a rotatably mounted catch for receiving a locking bolt. The locking mechanism moreover comprises a pawl with which the catch can be latched.

The catch of a motor vehicle lock usually comprises a fork-shaped inlet slot into which the locking bolt of a vehicle door or hatch, e.g. a hood or a trunk lid, enters when the door or hatch is locked. The locking bolt then turns the catch from an opened position into a closed position. If the catch has reached the closed position, it is latched over the pawl in this position. The locking bolt can then no longer leave the inlet slot of the catch. This latching position is referred to as the main latching position.

In the case of a motor vehicle, the locking bolt can be attached to a door or hatch of the motor vehicle, and the lock on the body, or vice versa.

There are motor vehicle locks with a second latching position, i.e. the so-called preliminary latching position. The preliminary latching position serves for catching the respective door or hatch when it does not reach the main latching position during the closing process.

Consequently, the catch is not completely closed in the preliminary latching position, but an opening movement of the catch is already prevented by a pawl. That is why the region of the catch that accommodates the pawl in this position is referred to as preliminary latching state. Finally, the catch is completely closed in the main latching position. The preliminary latching state thus constitutes a transitional state between the opened state and the main latching state and is provided for safety reasons.

The catch is one of the largest and, with regard to its shape, most complex components of a motor vehicle door lock, or of its locking mechanism, with a correspondingly large share in the overall production costs of a motor vehicle door lock.

Usually, a catch is produced by fine cutting, which is also referred to as fine punching, from a metal sheet with the thickness of the subsequent catch, which requires much effort and is very expensive. In addition, the two-dimensional and three-dimensional design of the shape of a catch is thus limited.

Document EP1126108B1 discloses a retaining member 1, e.g. a catch, for a motor vehicle lock which is formed by two spaced-apart metal sheets of equal thickness connected by a plastic casing. The casing forms a carrier attachment part 8 for a return spring. With respect to the tensile stresses applied, the casing, however, has a comparatively low mechanical strength (see document WO 2014063804A1, page 1, lines 28 to 31).

Document WO 2014063804A1 discloses a method for producing locking mechanism components in which thin metal sheet plates of equal thickness are stacked one above the other and connected to each other by clinching.

The object of the invention is to provide an locking mechanism component that has been developed further.

The object of the invention is accomplished by the subject matter having the features of claim 1, and by method having the features of the co-ordinated claim. Advantageous embodiments are apparent from the dependent claims.

Unless otherwise stated below, the subject matter of the invention can be combined in any way with one or more features mentioned in the introduction to the description of a locking mechanism component and of a motor vehicle lock with a locking mechanism, preliminary latching position and main latching position.

A locking mechanism component serves for achieving the object, in particular a catch, for a motor vehicle lock for retaining and securing a closing member in a closed position of a door or hatch of a motor vehicle, comprising at least one first punched metal sheet and one second punched metal sheet, wherein the punched metal sheets are connected to each other in a non-detachable manner and the first punched metal sheet, compared to the second punched metal sheet, has a different punched metal sheet material and/or a greater punched metal sheet thickness, wherein the first punched metal sheet and the second punched metal sheet have at least partially or predominantly an identical outer contour and/or are disposed stacked one above the other in such a way that sections with an identical outer contour are disposed flush with each other on the outside.

A locking mechanism component is a part of the locking mechanism of a motor vehicle lock, i.e. in particular a catch, pawl or the like.

Retaining and securing a closing member in a closed position of a door or hatch means that the locking mechanism component is made in such a way that it is capable, directly as in the case of a catch, or indirectly by the transmission of forces like a closing member, in particular a locking bolt, as in the case of a pawl, to counteract or prevent an inadvertent departure from the locking mechanism.

A punched metal sheet is a metal sheet produced by punching, in particular consisting of metal.

Connected to each other in a non-detachable manner means that detaching is possible only by damaging or destroying the locking mechanism, e.g. in the case of punched metal sheets connected with a press fit by means of a rivet or bolt.

at least one first punched metal sheet and one second punched metal sheet means that further punched metal sheets like the at least the first punched metal sheet and/or the second punched metal sheet can be provided in the same manner.

Greater punched metal sheet thickness means that a greater nominal thickness is provided. This does not denote production-related differences in thickness.

Different punched metal sheet material may be two different materials, different metals or the same metal with a different alloy and/or different heat treatment.

In particular, the first punched metal sheet, compared to the second punched metal sheet, is produced from a stronger material, with a strength-increasing alloy and/or a strength-increasing heat treatment. On the one hand, by dispensing with one of the above-described costly materials or treatments in the case of the second punched metal sheet, a locking mechanism component can be provided with particularly low production costs or production expenditure, and on the other hand, particularly complex contours can be produced with less effort and/or deformed by bending particularly easily, because of the particularly good deformability—which is due to the low strength—of the second punched metal sheet. A greater freedom of design can thus be made possible.

Identical outer contour means the peripheral contour of a flat locking mechanism component, which, when two punched metal sheets are stacked or stacked one above the other, i.e. when they are laid one above the other in a flat manner with the flat top and undersides, can be disposed on one another or one above the other in such a way that the outer contours of the two punched metal sheet can be aligned at the edge, i.e. can be disposed flush with one another on the outside.

With a locking mechanism component configured in accordance with the invention, a particularly high overall strength can be achieved, together with a low production expenditure and a high degree of designing freedom. In principle, providing a particularly large number of stacked metal sheets in the case of a motor vehicle lock component over an extended period of time can result in increased wear and problems regarding strength due to the alternating loads and vibrations during driving. At the same time, a particularly high degree of designing freedom can be made possible by a particularly large number of stacked metal sheets. In the exemplary embodiments illustrated therein, document WO2014063804A1 shows a plurality of differently formed components with a particular complexity, which can be made possible by providing a particularly large number of stacked metal sheets. In contrast, document EP 1126108B1 shows in the illustrated exemplary embodiments a large-surface component, which is exposed to great loads, consisting of only two metal sheets of equal thickness, wherein only the plastic casing basically constitutes a weak point with regard to the strength.

The invention is based on the idea that, in the case of certain locking mechanism components, particularly in the case of large-surface locking mechanism components with high operational loads, e.g. a catch, a higher fatigue strength due to one or at least few thick punched metal sheets is to be preferred, wherein providing one or more additional thin punched metal sheet may make an additional designing freedom possible. A particularly high longevity, particularly in the case of continuous loads due to vibrations during driving, can thus be attained. Also, complex shapes can thus be produced particularly simply, e.g. by means of sections with a reduced punched metal sheet thickness, i.e. a local reduction of the number of the punched metal sheet layers. Furthermore, a particularly low number of interfaces between the punched metal sheets can counteract loosening and premature wear.

A particular advantage is that fine punching, which requires effort and, due to the cost-intensive tools, expenditure, can be dispensed with. Punched metal sheets with a thickness that is lower compared to the overall thickness of the locking mechanism component are not only capable of being formed, e.g. punched out, particularly easily, but also of being treated further, e.g. hardened, and/or processed, e.g. connected to each other, with particularly little effort. In particular, stacking can be carried out particularly efficiently and effectively using a jig due to better possibilities for guidance. In addition, a second punched metal sheet can be used for forming special geometries with special mechanical loads, e.g. by bending, in order thus to produce a fitting portion or a retaining means for a spring or an adjacent force-transmitting component. A higher strength and a lower wear can thus be attained compared to corresponding fitting portions or retaining means consisting of plastic.

In an advantageous embodiment, the locking mechanism component comprises a punched metal sheet with a protrusion bent out from a plane of the punched metal sheet.

Basically, a plane of a punched metal sheet is spanned by a flat top or underside of a punched metal sheet or is parallel thereto.

Complex three-dimensional geometries, e.g. a fitting portion or retaining means, can thus be produced particularly easily.

In an advantageous embodiment, the bent protrusion is bent orthogonally relative to a plane of the punched metal sheet and/or the second punched metal sheet comprises the bent protrusion.

Due to the fact that the second punched metal sheet with the lower thickness is bent, unplanned and irregular curved portions and deformations of the punched metal sheet in the plane of the punched metal sheet, and thus unwanted gap formation, can be counteracted. A higher strength compared with fitting portions of plastic is made possible.

In particular, the protrusion is longer than it is wide.

In particular, the width of the protrusion corresponds to at least the punched metal sheet thickness, preferably three times, particularly preferably five times, and/or at most 30 times, preferably 20 times, particularly preferably ten times the punched metal sheet thickness.

In particular, the length of the protrusion, i.e. the projecting portion starting from the outer contour, corresponds to at least the width of the protrusion, preferably twice the width of the protrusion, and/or at most five times the width of the protrusion, preferably four times, particularly three times the width of the protrusion.

A sufficient transmission of forces can be ensured by the above-described configuration of the dimensioning of the protrusion.

In particular, the locking mechanism component provides at most five, preferably at most four, particularly preferably at most three punched metal sheets.

Among other things, a particularly high fatigue strength can thus be obtained. Other advantages were already described above in connection with the locking mechanism component according to the invention.

In an advantageous embodiment, the outer contours or the overall shape, i.e. the outer contour and the surface delimited by the outer contour, are identical in a punched metal sheet plane of the first punched metal sheet and of the second punched metal sheet, in particular of all punched metal sheets of the locking mechanism component, with the exception of the protrusion.

Among other things, a particularly high fatigue strength can thus be obtained. Other advantages were already described above in connection with the locking mechanism component according to the invention.

In an advantageous embodiment, the locking mechanism component is made such that on one punched metal sheet, which is a punched metal sheet of the type of the first punched metal sheet, directly lies another punched metal sheet of the type of the first punched metal sheet, and that a punched metal sheet of the type of the second punched metal sheet is stacked thereupon, in particular directly, and/or that a punched metal sheet of the type of the first punched metal sheet is arranged as the lowermost punched metal sheet and/or a punched metal sheet of the second type of punched metal sheet is arranged as the uppermost punched metal sheet.

Among other things, a particularly high strength and designing freedom can thus be obtained. Other advantages were already described above in connection with the locking mechanism component according to the invention.

In particular, the first punched metal sheet has a punched metal sheet thickness of at least 1.5 mm, preferably at least 1.75 mm, particularly preferably at least 2.0 mm, and/or at most 3 mm, preferably at most 2.75 mm, particularly preferably at most 2.5 mm.

In particular, the second punched metal sheet has a punched metal sheet thickness of at least 0.5 mm, preferably at least 0.75 mm, particularly preferably at least 1.0 mm, and/or at most 2 mm, preferably at most 1.75 mm, particularly preferably at most 1.5 mm.

In particular, the second punched metal sheet is hardened and/or consists of a stronger steel than the first punched metal sheet.

In an advantageous embodiment, the punched metal sheets are connected to each other in a non-detachable manner by at least two bolts and/or rivets, preferably exactly three bolts and/or rivets.

Among other things, a particularly small production expenditure can thus be made possible. Other advantages were already described above in connection with the locking mechanism component according to the invention.

In particular, a bolt or a rivet is disposed in the region of a protrusion and/or in the region of mechanically stressed points, e.g. contact points for latching into the main latching and/or preliminary latching state.

Among other things, a particularly high fatigue strength can thus be obtained.

In one embodiment, the punched metal sheets are only and/or additionally connected to each other by cold welding and/or burr protrusion.

Among other things, a particularly small production expenditure can thus be made possible.

In one embodiment, the punched metal sheets are at least partially overmolded with plastic in order to form an outer casing around the punched metal sheets.

In particular, the plastic casing around the punched metal sheets predominantly has a thickness of at least 0.5 mm, preferably at least 0.75 mm, particularly preferably at least 1.0 mm, and/or at most 2 mm, preferably at most 1.75 mm, particularly preferably at most 1.5 mm.

Among other things, a particularly high strength and designing freedom can thus be obtained. Other advantages were already described above in connection with the locking mechanism component according to the invention.

In one embodiment, at least one surface region of the punched metal sheets in the locking mechanism component can come directly into contact with another locking mechanism component or locking mechanism part, in particular a pawl—it is therefore, in particular, not covered with plastic—and/or latch into a preliminary latching position and/or a main latching position.

For example, the surface regions of a catch as a locking mechanism component are not coated by any plastic layer in order to be able to directly latch with a pawl.

A particularly high level of wear resistance can thus be achieved, because adjacent parts, for example for latching, come into contact not with plastic, but directly with a punched metal sheet in order to transmit forces.

In one embodiment, at least one surface region of the punched metal sheets in the locking mechanism component, in particular a catch, is not covered with plastic, in which a bolt and/or a rivet exits or is disposed on the surface.

A locking mechanism component can thus be produced particularly simply and with little effort, e.g. by a simple fixation option in an injection-molding tool.

Another aspect of the invention relates to a method for producing a locking mechanism component, in particular a catch, for a motor vehicle lock for retaining and securing a closing member in a closed position of a door or hatch of a motor vehicle, comprising the following steps:

At least one first punched metal sheet and one second punched metal sheet, which has a different punched metal sheet material and/or a different punched metal sheet thickness, are punched out. In particular, a protrusion of the second punched metal sheet is then bent out from a plane of the punched metal sheet. Preferably thereafter, at least the first punched metal sheet is heat-treated. Using a jig, the punched metal sheets are positioned stacked one above the other in such a way that sections with an identical outer contour are disposed flush with one another on the outside. A non-detachable connection of the punched metal sheets to each other follows, in particular with at least one bolt with a press fit and/or with a rivet. The stacked and connected punched metal sheets are then inserted into an injection mold and overmolded with plastic.

A locking mechanism component with a particularly large designing freedom and a particularly great strength or fatigue strength can be provided by means of the above-described method with a particularly small production expenditure. Due to the metal sheet thickness, which is reduced compared with the overall thickness of the subsequent locking mechanism component, the punching and heat-treatment processes can by carried out particularly easily, quickly and with little effort.

Exemplary embodiments of the invention will be explained below in more detail with reference to Figures. Features of the exemplary embodiment can be combined individually or in a plurality with the subject matter for which protection is sought.

In the drawing:

FIG. 1: shows a locking mechanism component in the form of a catch of a motor vehicle lock.

FIG. 1 shows as a locking mechanism component 1 a catch for a motor vehicle lock, comprising a fork-shaped inlet slot into which the locking bolt, which is not shown, of a vehicle door or hatch enters when the door or hatch is locked.

The locking mechanism component 1 or catch comprises three punched metal sheets 3, 4, 5, wherein the lowermost punched metal sheet 3 and the middle punched metal sheet 4 are punched metal sheets 3, 4 of the type of the first punched metal sheet 3, 4. A punched metal sheet 5 of the type of the second punched metal sheet 5 is arranged stacked thereupon. The punched metal sheets 3, 4, 5 are connected to each other in a non-detachable manner and surrounded by or overmolded with an outer casing 6.

Because the lower two punched metal sheets 3, 4 have a greater punched metal sheet thickness than the upper punched metal sheet 5 and are additionally hardened, the catch can be produced with only three punched metal sheets 3, 4, 5, obtaining a particularly high strength and yet a particularly great designing freedom. Due to the small punched metal sheet thickness, the upper punched metal sheet 5 allows for a particularly easy forming process. A protrusion 7 with a particularly high mechanical load-bearing capacity can thus be produced by bending in a direction orthogonal to the plane 2 of the punched metal sheet without additionally affecting the strength of the catch. Functional members with a low mechanical load are additionally formed in the outer casing 6.

In order to reduce the wear, three surface regions 9 are not enveloped by the outer casing 6 so that a direct contact between the punched metal sheets 3, 4, 5 and the force-transmitting locking mechanisms parts, such as a pawl, in the preliminary latching position or the main latching position can be made possible.

The punched metal sheets 3, 4, 5 are connected to each other in a non-detachable manner by at least two rivets 8. With the exception of the protrusion or the region of the protrusion, the punched metal sheets 3, 4, 5 in this case have an identical outer contour and, accordingly, are arranged stacked on one another in such a way that sections with an identical outer contour are disposed flush with one another on the outside.

In particular, the locking mechanism component 1 has an opening 10 in order to pass a bolt therethrough, for example, which, preferably enveloped by the outer casing 6, can serve as a counter support for a torsion spring.

For producing the locking mechanism component 1, at least one first punched metal sheet 3, 4 and one second punched metal sheet 5, which has a different punched metal sheet material and/or a different punched metal sheet thickness, are punched out.

Then, a protrusion 7 of the second punched metal sheet 5 is bent out from a plane 2 of the punched metal sheet.

A heat treatment may then follow, which, due to the metal sheet thickness, which is reduced compared with the overall thickness of the subsequent locking mechanism component 1, can by carried out particularly easily, quickly and with little effort.

Using a jig, the punched metal sheets 3, 4, 5, in particular using an opening 10 orthogonal to the plane 2 of the punched metal sheet, can be positioned stacked one above the other in such a way that sections with an identical outer contour are disposed flush with one another on the outside. The non-detachable connection of the punched metal sheets 3, 4, 5 to each other follows, in particular with at least one bolt with a press fit and/or with rivets 8.

Finally, the stacked and connected punched metal sheets are inserted into an injection mold and overmolded with plastic.

The invention claimed is:

1. A locking mechanism component for a motor vehicle lock, the locking mechanism component being configured for retaining and securing a closing member in a closed position of a door or hatch of a motor vehicle, the locking mechanism component comprising:

at least one first punched metal sheet; and one second punched metal sheet, wherein the punched metal sheets are connected to each other in a non-detachable manner and the first punched metal sheet, compared to the second punched metal sheet, has a different punched metal sheet material and/or a greater punched metal sheet thickness, wherein the first punched metal sheet and the second punched metal sheet have at least partially an identical outer contour and are disposed stacked one above the other wherein sections of the first and second punched metal sheets with the identical outer contour are disposed flush with each other to define an outer surface of the locking mechanism component, wherein one of the first punched metal sheet and the second punched metal sheet include a protrusion bent out from a plane thereof, wherein the protrusion is configured for load-bearing for a force-transmitting component of the motor vehicle lock, the protrusion being bent orthogonally to the plane.

2. The locking mechanism component according to claim 1, wherein each identical outer contour is identical in a punched metal sheet plane of the first punched metal sheet and of the second punched metal sheet.

3. The locking mechanism component according to claim 1, wherein the first and second punched metal sheets are connected to each other by at least two bolts and/or rivets.

4. The locking mechanism according to claim 3, wherein the first and second punched metal sheets are connected to each other by three bolts and/or rivets.

5. The locking mechanism component according to claim 1, wherein the first and second punched metal sheets are at least partially overmolded with plastic to form an outer casing around the first and second punched metal sheets.

6. The locking mechanism component according to claim 1, wherein the at least one first punched metal sheet includes two punched metal sheets, wherein one of the two punched metal sheets directly lies on the other one of the two punched metal sheets, wherein the second punched metal sheet is a different type of metal sheet and is disposed stacked on the two punched metal sheets.

7. The locking mechanism according to claim 6, wherein the two punched metal sheets of the same type each have a same thickness that is greater than a thickness of the second punched metal sheet.

8. The locking mechanism component according to claim 1, wherein the first punched metal sheet is arranged as a lowermost punched metal sheet and the second punched metal sheet is disposed as an uppermost punched metal sheet.

9. The locking mechanism component according to claim 1, wherein at least one surface region of the first and second punched metal sheets in the locking mechanism component can come directly into contact with at least one of another locking mechanism part, a latch when in a preliminary latching position, and the latch when in a main latching position.

10. The locking mechanism component according to claim 1, wherein the locking mechanism is a catch.

11. The locking mechanism according to claim 1, wherein the protrusion is bent out from the plane of the second punched metal sheet.

12. The locking mechanism according to claim 1, wherein the second punched metal sheet has a thickness that is less than a thickness of the first punched metal sheet.

13. The locking mechanism according to claim 1, wherein the first punched metal sheet and the second punched metal sheet are formed of different metal materials.

14. The locking mechanism according to claim 1, wherein the first punched metal sheet and the second punched metal sheet have at least one of a different alloy composition and a different heat treatment.

15. The locking mechanism according to claim 1, wherein the second punched metal sheet is formed of a material that is configured for greater deformation as compared with a material of the first punched metal sheet.

16. The locking mechanism according to claim 1, wherein the sections of the first and second punched metal sheets with the identical outer contour are aligned at a peripheral edge of the locking mechanism.

17. A method for producing a locking mechanism component for a motor vehicle lock, the locking mechanism component being configured for retaining and securing a closing member in a closed position of a door or hatch of a motor vehicle, the method comprising:

punching out at least one first punched metal sheet and one second punched metal sheet, which have a different punched metal sheet material and/or a different punched metal sheet thickness;

bending out a protrusion of the second punched metal sheet orthogonally to a plane of the second punched metal sheet, wherein the protrusion is configured for load-bearing for a force-transmitting component of the motor vehicle lock;

using a jig to position the first and second punched metal sheets in a stacked arrangement one above the other in such a way that sections with an identical outer contour are disposed flush with one another on an outside of the locking mechanism component;

connecting the first and second punched metal sheets to each other in a non-detachable manner with at least one bolt with a press fit and/or with a rivet;

inserting the stacked and connected first and second punched metal sheets are into an injection mold in which the first and second punched metal sheets are overmolded with plastic.

* * * * *